US008302409B2

(12) United States Patent
Fukuda

(10) Patent No.: US 8,302,409 B2
(45) Date of Patent: Nov. 6, 2012

(54) CRYOPUMP AND REGENERATING METHOD OF THE CRYOPUMP

(75) Inventor: Tsutomu Fukuda, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 1169 days.

(21) Appl. No.: 11/599,251

(22) Filed: Nov. 15, 2006

(65) Prior Publication Data

US 2007/0256429 A1 Nov. 8, 2007

(30) Foreign Application Priority Data

May 2, 2006 (JP) ..... 2006-128499

(51) Int. Cl.
*B01D 8/00* (2006.01)

(52) U.S. Cl. ..... 62/55.5; 62/100; 62/6; 417/901

(58) Field of Classification Search ..... 62/55.5, 62/100, 6; 417/901
See application file for complete search history.

(56) References Cited

U.S. PATENT DOCUMENTS 4,438,631 A * 3/1984 Sarcia ..... 62/6
5,386,708 A * 2/1995 Kishorenath et al. ..... 62/55.5
5,513,499 A * 5/1996 deRijke ..... 62/55.5
5,517,823 A * 5/1996 Andeen et al. ..... 62/55.5
5,582,017 A * 12/1996 Noji et al. ..... 62/55.5
6,116,032 A * 9/2000 Mori et al. ..... 62/55.5
6,461,113 B1 * 10/2002 Gaudet et al. ..... 417/27

FOREIGN PATENT DOCUMENTS

JP 02095779 A * 4/1990
JP 07-035070 2/1995

OTHER PUBLICATIONS

Capture Pumping Technology (second edition) 2001, Chapter 5, Cryopumping, pp. 255-343. see particularly p. 318.*

* cited by examiner

*Primary Examiner* — John Pettitt
(74) *Attorney, Agent, or Firm* — Rader, Fishman & Grauer PLLC

(57) ABSTRACT

A cryopump and a regenerating method of the cryopump whereby temperatures of a first stage and a second stage can be securely increased to target temperatures and time required for regenerating can be shortened are provided. At the time of regenerating, the temperature of the second stage cooling stage is controlled based on the temperature detected by the second temperature detection part. In the case where the temperature of the first stage cooling stage reaches the limiting temperature, namely critical temperature, of the first stage displacer, the rotation in the reverse direction of the reversible motor is controlled or stopped and thereby the regenerating process is stopped for a while.

14 Claims, 10 Drawing Sheets

FIG.8

| | TEMPERATURE CONDITIONS | | | | | | | | |
|---|---|---|---|---|---|---|---|---|---|
| | P1 | P2 | P3 | P4 | P5 | P6 | P7 | P8 | P9 |
| STATUS | | | | | | | | | |
| MOTOR STOP (WAITING FOR T1 RESTART) 10 | START RISING-TEMPERATURE CONTROL | — | — | START RISING-TEMPERATURE CONTROL | — | — | MOTOR STOP (WAITING FOR T2 RESTART) | MOTOR STOP (WAITING FOR T2 RESTART) | MOTOR STOP (WAITING FOR T2 RESTART) |
| | 30 | 10 | 10 | 30 | 10 | 10 | 20 | 20 | 20 |
| MOTOR STOP (WAITING FOR T2 RESTART) 20 | START RISING-TEMPERATURE CONTROL | START RISING-TEMPERATURE CONTROL | MOTOR STOP (WAITING FOR T1 RESTART) | — | — | — | — | — | — |
| | 30 | 30 | 10 | 20 | 20 | 20 | 20 | 20 | 20 |
| ROTATION IN REVERSE DIRECTION OF MOTOR 30 | — | — | MOTOR STOP (WAITING FOR T1 RESTART) | — | — | MOTOR STOP (WAITING FOR T1 RESTART) | MOTOR STOP (WAITING FOR T2 RESTART) | MOTOR STOP (WAITING FOR T2 RESTART) | MOTOR STOP (WAITING FOR T2 RESTART) |
| | 30 | 30 | 10 | 30 | 30 | 10 | 20 | 20 | 20 |

CRYOPUMP AND REGENERATING METHOD OF THE CRYOPUMP

BACKGROUND OF THE INVENTION

1. Field of the Invention

The present invention generally relates to cryopumps and regenerating methods of the cryopumps. More particularly, the present invention relates to a cryopump configured to implement a regenerating process by reverse-operating a cryogenic cooler and a regenerating method of the cryopump.

2. Description of the Related Art

In semiconductor manufacturing equipment, for example, it is necessary to realize a high vacuum state. Accordingly, cryopumps are frequently used as vacuum pumps for realizing the high vacuum state. The cryopump requires a cryogenic cooler in the principle of vacuum production. As the cryogenic cooler used for the cryopump, a Gifford McMahon cycle type cryogenic cooler (hereinafter "GM-type cryogenic cooler") is known.

The GM-type cryogenic cooler and a cryopanel or the like provided in a pump housing are thermally connected to each other. In a cooling process, a gaseous substance in the pump housing is condensed and absorbed into the cryopanel or the like, so that the high vacuum state can be realized.

Regenerating is required for the cryopump having the above-mentioned structure. Regenerating is a process wherein heat is applied to the gaseous substance condensed and absorbed into the cryopanel or the like in the cooling process so that the temperature is increased and the substance is liquefied and boiled to become gas again so as to be discharged outside of a pump vessel.

Therefore, in the regenerating process, it is necessary to heat (raise the temperature) of the cryopanel or a stage of the GM-type cryogenic cooler thermally connected to the cryopanel. As a method for raising the temperature, for example, a method discussed in Japanese Patent No. 2567369 is known.

In the method discussed in Japanese Patent No. 2567369, a temperature rising cycle is realized by reversing a cooling cycle of the cryogenic cooler and the cryogenic cooler itself is used as a heat source.

In this method, a motor for reciprocally moving a displacer in a cylinder via a crank mechanism is rotated in a reverse direction. In addition, the operational timing of a valve is changed 180 degrees compared to an operation for a cooling cycle, so that the cooling cycle is reversed and a temperature rising cycle is conducted by operating the cryogenic cooler as heat generation means. This heat generation means does not require special equipment and only reversing the cooling cycle is required. Therefore, its structure is simple and convenient.

FIG. 1 is a structural view of a related art cryopump. More specifically, FIG. 1 shows a cryopump 1 which realizes a temperature rising cycle by reversing a cooling cycle of a cryogenic cooler.

The cryopump 1 is attached to a process chamber not shown in FIG. 1, such as a semiconductor manufacturing apparatus. The cryopump 1 evacuates the inside of the process chamber. The cryopump 1 includes a compressor 1, a vacuum vessel 4, a cryogenic cooler 5, a shield 9, a cryopanel 10, a controller 17, and others.

A compressor 3 raises the temperature of coolant gas such as helium gas so as to transfer the gas to the cryogenic cooler 5. In addition, the compressor 3 receives coolant gas that is adiabatically expanded by the cryogenic cooler 5 so as to raise the temperature of coolant gas again.

The vacuum vessel 4 is attached to the above-mentioned process chamber. The cryogenic cooler 5, the cryopanel 10, and others are provided in the process chamber. A gate valve not shown in FIG. 1 is provided between the vacuum vessel 4 and the process chamber. By closing the gate valve, the vacuum vessel 4 is isolated from the process chamber in an airtight manner.

The cryogenic cooler 5 is a GM-type cryogenic cooler. The cryogenic cooler 5 includes a first stage cylinder 14, a second stage cylinder 15, a reversible motor 16, and others.

A first stage displacer 14A is provided inside the first stage cylinder 14 so as to reciprocally move in upper and lower directions in FIG. 1. In addition, a second stage displacer 15A is provided inside the second stage cylinder 15 so as to reciprocally move in upper and lower directions in FIG. 1.

The first stage displacer 14A and the second stage displacer 15A are connected to each other and reciprocally move inside the cylinders 14 and 15 by using the reversible motor 16 as a driving source.

In addition, a first stage expansion room is formed between the first stage cylinder 14 and the first stage displacer 14A. A second stage expansion room is formed between the second stage cylinder 15 and the second stage displacer 15A. Volumes of the first stage expansion room and the second stage expansion room are changed by reciprocal moving of the displacers 14A and 15A.

The reversible motor 16 can be rotated in a forward direction and in a reverse direction. The reversible motor 16 is connected to the controller 17. Following instructions from the controller 17, rotation in the forward direction or the reverse direction can be selected.

A first stage cooling stage 7 is provided around an external periphery of the first stage cylinder 14. In addition, a shield 9 as a first cryopanel is provided at the first stage cooling stage 7. The shield 9 prevents outside heat from being transferred to the cryopanel 10.

Furthermore, a louver 12 is provided at the shield 9 so as to be positioned in the vicinity of an upper part opening of the vacuum vessel 4.

A second stage cooling stage 8 is provided around an external periphery of the second stage cylinder 15. In addition, the cryopanel 10 as a second cryopanel is provided at the second stage cooling stage 8. Activated carbon 11 is provided in the cryopanel 10.

In the cryopump having the above-mentioned structure, when a vacuum process is implemented, the controller 17 rotates the reversible motor 16 in the forward direction. Because of this, the cryogenic cooler 5 is in a cooling mode so that the coolant gas supplied from the compressor 3 to the first stage expansion room and the second stage expansion room is adiabatically expanded as the displacers 14A and 15A move and thereby a cold state is generated.

As a result of this, the first stage cooling stage 7 is cooled at, for example, approximately 30 through 100 K, and the shield 9 is cooled at, for example, a temperature equal to or less than approximately 100 K. In addition, the second stage cooling stage 8 is cooled at, for example, approximately 4 through 20 K, and the cryopanel 10 is cooled at, for example, a temperature equal to or less than approximately 20 K.

Gaseous substances in the process chamber enter from the opening of the upper part into the vacuum vessel 4. Water or carbon dioxide is condensed by mainly the louver 12 and the shield 9. Argon and nitrogen are condensed by mainly the cryopanel 10. Hydrogen, neon, helium, and others are absorbed by mainly the activated carbon 11. Thus, the process chamber is evacuated so that the high vacuum state can be realized.

As discussed above, a gas substance such as argon discharged from inside the process chamber is condensed or absorbed by the shield 9, the cryopanel 10, and the activated carbon 11. Therefore, as the amount of the condensed or absorbed substance is increased, a discharging ability of the cryopump 1 is degraded. Because of this, as discussed above, the regenerating process for discharging substances condensed or absorbed by the cryopump 1 is required.

Next, the regenerating process of the related art cryopump 1 is discussed.

In the regenerating process discussed below, the reversible motor 16 is rotated in the reverse direction so that the cooling cycle of the cryogenic cooler 5 is reversed. By reversing the cooling cycle of the cryogenic cooler 5, the coolant gas is adiabatically compressed in the first stage expansion room and the second stage expansion room, so that adiabatic compression heat is generated.

Temperatures of the shield 9 and the cryopanel are raised by the adiabatic compression heat via the cylinders 14 and 15 and the cooling stages 7 and 8 so that the regenerating process is implemented.

FIG. 2 is a flowchart indicating a regenerating process implemented by the controller 17 in the related art.

In the process shown in FIG. 2, the regenerating process is implemented based on temperature of the first stage cooling stage 7. Because of this, a first stage temperature sensor 18 is provided at the first stage cooling stage 7. The temperature of the first stage cooling stage 7 detected by the first stage temperature sensor 18 is sent to the controller 17.

When the regenerating process shown in FIG. 2 is started, the controller 17 rotates the reversible motor 16 in a reverse direction in step S10. Because of this, the mode of the cryogenic cooler 5 is switched from the cooling mode to the regenerating mode, so that, as discussed above, the coolant gas is adiabatically compressed in the first stage expansion room and the second stage expansion room and thereby the adiabatic compression heat is generated.

Temperatures of the shield 9 and the cryopanel are raised by the adiabatic compression heat via the cylinders 14 and 15 and the cooling stages 7 and 8 so that the regenerating process is implemented.

At this time, purge gas such as nitrogen gas is introduced in the vacuum vessel 4 and substance such as argon, returned to a gaseous state by the regenerating process together with the purge gas are discharged from the vacuum vessel 4.

In step S11, whether temperature T1 of the first stage cooling stage 7 detected by the first stage temperature sensor 18 becomes a target temperature for regenerating is determined. By the process in step S11, rotation in the reverse direction of the reversible motor 16 continues until the temperature T1 of the first stage cooling stage 7 detected by the first stage temperature sensor 18 becomes the target temperature.

When the temperature T1 of the first stage cooling stage 7 is determined to become the target temperature in step S11, the process goes to step S12 so that the controller 17 switches the mode of the cryopump 1 to a temperature control mode. In this temperature control mode, the rotational speed of the reversible motor 16 is decreased and supply of the purge gas is stopped.

However, in the cryopump 1 where the cooling cycle of the cryogenic cooler is reversed by rotating the reversible motor 16 in the reverse direction so that the regenerating process is implemented, it is not possible to control rising temperatures of the first stage cooling stage 7 and the second stage cooling stage 8 independently.

In other words, compression expansion heat generated in the first and second expansion rooms is proportional to expansion volumes of the first and second stage cylinders.

The diameter of the first stage cylinder 14 is larger than the diameter of the second stage cylinder 15. The stroke amount of the first stage displacer 14A is equal to the stroke amount of the second stage displacer 15A. Because of this, the volume of the first stage expansion room is larger than the volume of the second stage expansion room. Therefore, a temperature rising rate of the first stage cooling stage 7 at the time of regenerating is greater than a temperature rising rate of the second stage cooling stage 8.

Details of this are discussed with reference to FIG. 3. Here, FIG. 3 is a graph showing temperature changes of the first stage cooling stage 7 and the second stage cooling stage 8 when a regenerating process is controlled based on the temperature detected by a first stage temperature sensor.

A solid line shows temperature change characteristic of the first stage cooling stage 7. A one point dotted line shows a temperature change characteristic of the second stage cooling stage 8. In addition, the graph shown in FIG. 3 shows an example where the regenerating process is controlled based on the temperature detected by the first stage temperature sensor 18 provided at the first stage cooling stage 7 discussed with reference to FIG. 2.

In rising temperature, when the rotational speed of the reversible motor 16 is adjusted by the temperatures detected by the first stage cooling stage 7 and the second stage cooling stage 8, the rotation speed of the reversible motor 16 may have to be frequently changed.

However, in the actual cryogenic cooler, the rotational speed cannot be frequently changed due to the characteristic of the reversible motor 16.

In the related art, the regenerating process is controlled based on only the temperature detected by the first stage temperature sensor 18 provided at the first stage cooling stage 7. Therefore, the mode is switched to the temperature control mode when the temperature of the first stage cooling stage 7 reaches the target temperature so that the rotation speed of the reversible motor 16 is decreased.

Because of this, at the time t1 when the temperature of the first stage cooling stage 7 reaches the target temperature T1, the temperature of the second stage cooling stage 8 has not reached the target temperature T2. Hence, after the temperature of the second stage cooling stage 8 reaches the target temperature T2 in the temperature control mode, the rotation in the reverse direction of the reversible motor 16 is completely stopped so that the regenerating process is finished.

However, in this regenerating method, while the temperature of the first stage cooling stage 7 reaches the target temperature T1 at the time t1, the temperature of the second stage cooling stage 8 reaches the target temperature T2 at the time t2.

Thus, it takes time $\Delta t$ for the temperature of the second stage cooling stage 8 to reach the target temperature T2 after the temperature of the first stage cooling stage 7 reaches the target temperature T1. Hence, in the related art, the regenerating process takes a long time.

FIG. 4 is a graph showing temperature changes of the first stage cooling stage 7 and the second stage cooling stage 8 when a regenerating process is controlled based on the temperature detected by a second stage temperature sensor provided at the second stage cooling stage 8.

The horizontal axis of the graph indicates time and the vertical axis of the graph indicates temperature.

A solid line shows the temperature change characteristic of the first stage cooling stage 7. A one point dotted line shows the temperature change characteristic of the second stage cooling stage 8.

In the regenerating method shown in FIG. 4, when the temperature of the second stage cooling stage 8 reaches the target temperature T2, the rotation of the reversible motor 16 is stopped and thereby the regenerating process is stopped.

In this method, since a time period during which the temperature of the second stage cooling stage 8 reaches the target temperature T2 can be shortened, time difference (Δt) between the time t1 when the temperature of the first stage cooling stage 7 reaches the target temperature T1 and the time t2 when the temperature of the second stage cooling stage 8 reaches the target temperature T2 can be shortened.

However, as discussed above, a temperature rising rate of the first stage cooling stage 7 at the time of regenerating is different from a temperature rising rate of the second stage cooling stage 8.

Therefore, the temperature of the first stage cooling stage 7 reaches the target temperature T1 before the temperature of the second stage cooling stage 8 reaches the target temperature T2. Rising temperature continues even after the time t1. Hence, in the first stage cooling stage 7, excess temperature rising indicated by an arrow ΔT occurs.

Because of this, the temperature of the first stage cooling stage 7 exceeds a reliability limiting (critical) temperature before the temperature of the second stage cooling stage 8 reaches the target temperature T2. Rising temperature continues even after the time t1, so that a problem may occur.

SUMMARY OF THE INVENTION

Accordingly, embodiments of the present invention may provide a novel and useful cryopump and regenerating method of the cryopump in which one or more of the problems described above are eliminated.

More specifically, the embodiments of the present invention can provide a cryopump and a regenerating method of the cryopump whereby temperatures of a first stage and a second stage can be securely increased to target temperatures and time required for regenerating can be shortened.

The embodiments of the present invention can also provide a cryopump, including:

a cryogenic cooler, the cryogenic cooler including first and second stage cylinders where first and second stage displacers, respectively, are reciprocally moved;

a reversible motor configured to drive the first and second stage displacers, which reversible motor can be rotated in forward and reverse directions; and first and second stage cooling stages provided at the first and second cylinders, respectively, the first and second stage cooling stages being cooled by rotation in the forward direction of the reversible motor and being heated by rotation in the reverse direction of the reversible motor;

first and second cryopanels thermally connected to the first and second stage cooling stages, respectively;

a first temperature detection part configured to detect a temperature of the first stage cooling stage at the time when the reversible motor is rotated in the reverse direction;

a second temperature detection part configured to detect a temperature of the second stage cooling stage at the time when the reversible motor is rotated in the reverse direction;

a first control part configured to control the temperature of the second stage cooling stage by controlling the rotation in the reverse direction of the reversible motor based on the temperature detected by the second temperature detection part; and a second control part configured to control the rotation in the reverse direction of the reversible motor in a case where the temperature of the first stage cooling stage detected by the first temperature detection part reaches a limiting temperature of the first stage displacer, the second control part being configured to return the rotation in the reverse direction of the reversible motor to the forward rotation in a case where the temperature of the first stage cooling stage is decreased to a returning temperature.

According to the above-mentioned cryopump, at the time of regenerating, the temperature of the second stage cooling stage is controlled based on the temperature detected by the second temperature detection part. In the case where the temperature of the first stage cooling stage reaches the limiting temperature, namely critical temperature, of the first stage displacer, the rotation in the reverse direction of the reversible motor is controlled or stopped and thereby the regenerating process is stopped for a while.

Therefore, the temperatures of the first stage cooling stage and the second stage cooling stage can be securely raised to the target temperatures without frequently changing the rotation speed of the reversible motor.

Hence, time required for regenerating can be shortened and too much increase of the temperature of the first stage cooling stage can be prevented.

In addition, the embodiments of the present invention can also provide a regenerating method of a cryopump, the cryopump including a cryogenic cooler wherein first and second stage displacers are reciprocally moved in first and second stage cylinders by a reversible motor so that first and second stage expansion space parts, respectively, are heated or cooled;

a first cryopanel thermally connected to the first stage cylinder via a first stage cooling stage;

a second cryopanel thermally connected to the second stage cylinder via a second stage cooling stage;

a first temperature detection part configured to detect a temperature of the first cryopanel at the time when the reversible motor is rotated in a reverse direction;

a second temperature detection part configured to detect a temperature of the second cryopanel at the time when the reversible motor is rotated in the reverse direction;

wherein the temperatures of the first and second cryopanels are increased by adiabatic compression heat generated in the first and second expansion space parts, respectively, by rotation in the reverse direction of the reversible motor so that the regenerating method is implemented, the regenerating method including:

a step of controlling the rotation in the reverse direction of the reversible motor based on the temperature detected by the second temperature detection part so that regenerating temperature of the second cryopanel is controlled;

a step of controlling the rotation in the reverse direction of the reversible motor in a case where the temperature of the first cryopanel detected by the first temperature detection part reaches a limiting temperature of the first stage displacer; and a step of returning the rotation in the reverse direction of the reversible motor to a forward rotation in a case where the temperature of the first cryopanel is decreased to a returning temperature.

According to the above-mentioned regenerating method of the cryopump, when the temperatures of the first and second stage displacers reach the limiting temperature, namely critical temperature, raising the temperature by the heating part is stopped. When the temperature of the cryopanel reaches the returning temperature, rising temperature by the heating part is restarted.

The heating part is not limited to the reverse rotation of the cryogenic cooler. The heating part may be a heater or the like. This case as well as the case of the reverse rotation of the cryogenic cooler is effective in that reliability of the cryopump can be maintained.

Other objects, features, and advantages of the present invention will become more apparent from the following detailed description when read in conjunction with the accompanying drawings.

BRIEF DESCRIPTION OF THE DRAWINGS

FIG. 8 is a view showing a regenerating process table based on the status table shown in FIG. 7;

DETAILED DESCRIPTION OF THE PREFERRED EMBODIMENT

A description will now be given, with reference to FIG. 5 through FIG. 10, of embodiments of the present invention.

Figure 5:
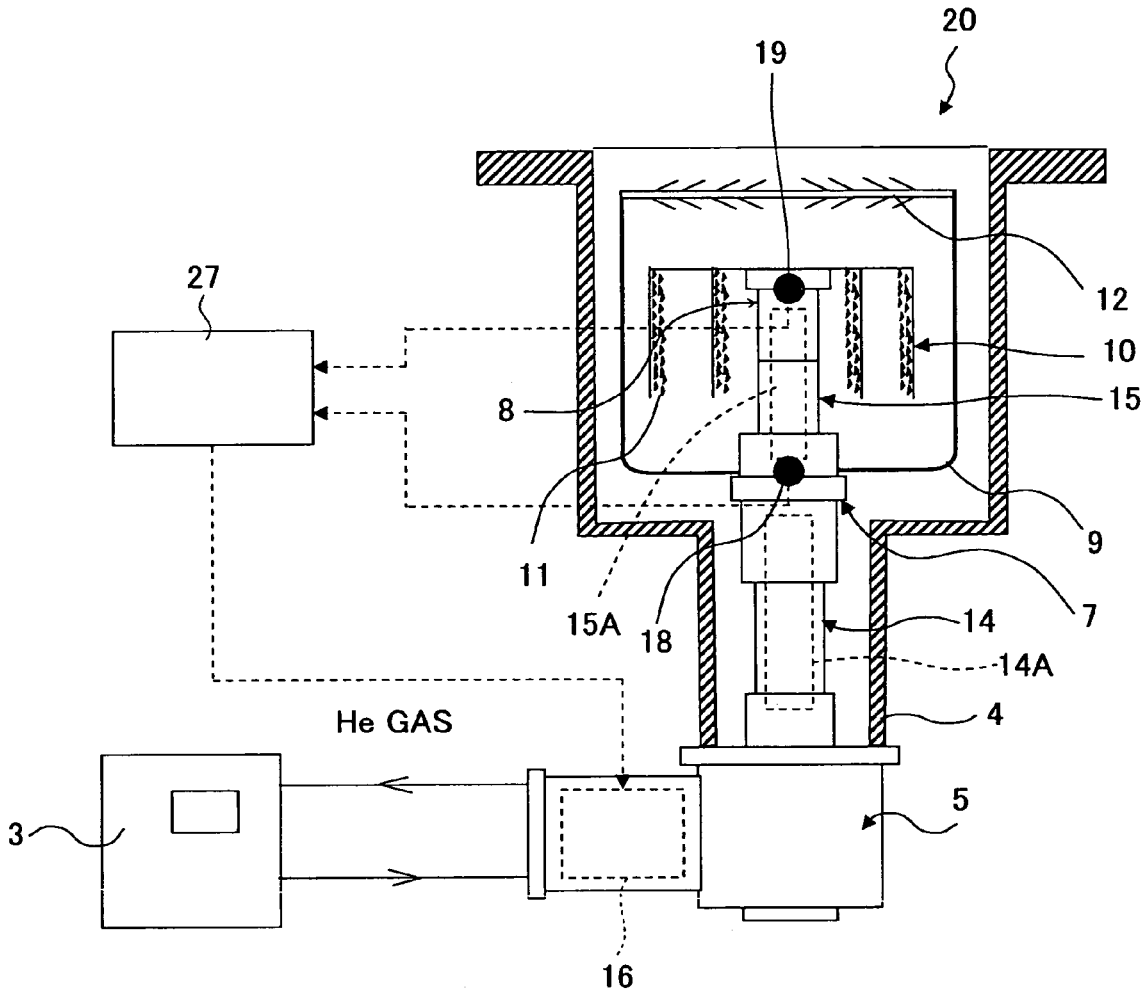
FIG. 5 is a structural view of a cryopump of an embodiment of the present invention.

FIG. 5 is a structural view of a cryopump 20 of an embodiment of the present invention. The structure of the cryopump 20 is similar to that of the cryopump 1 shown in FIG. 1. Therefore, in the cryopump 20 shown in FIG. 5, parts that are the same as the parts in the cryopump 1 shown in FIG. 1 are given the same reference numerals, and explanation thereof is omitted.

Figure 1:
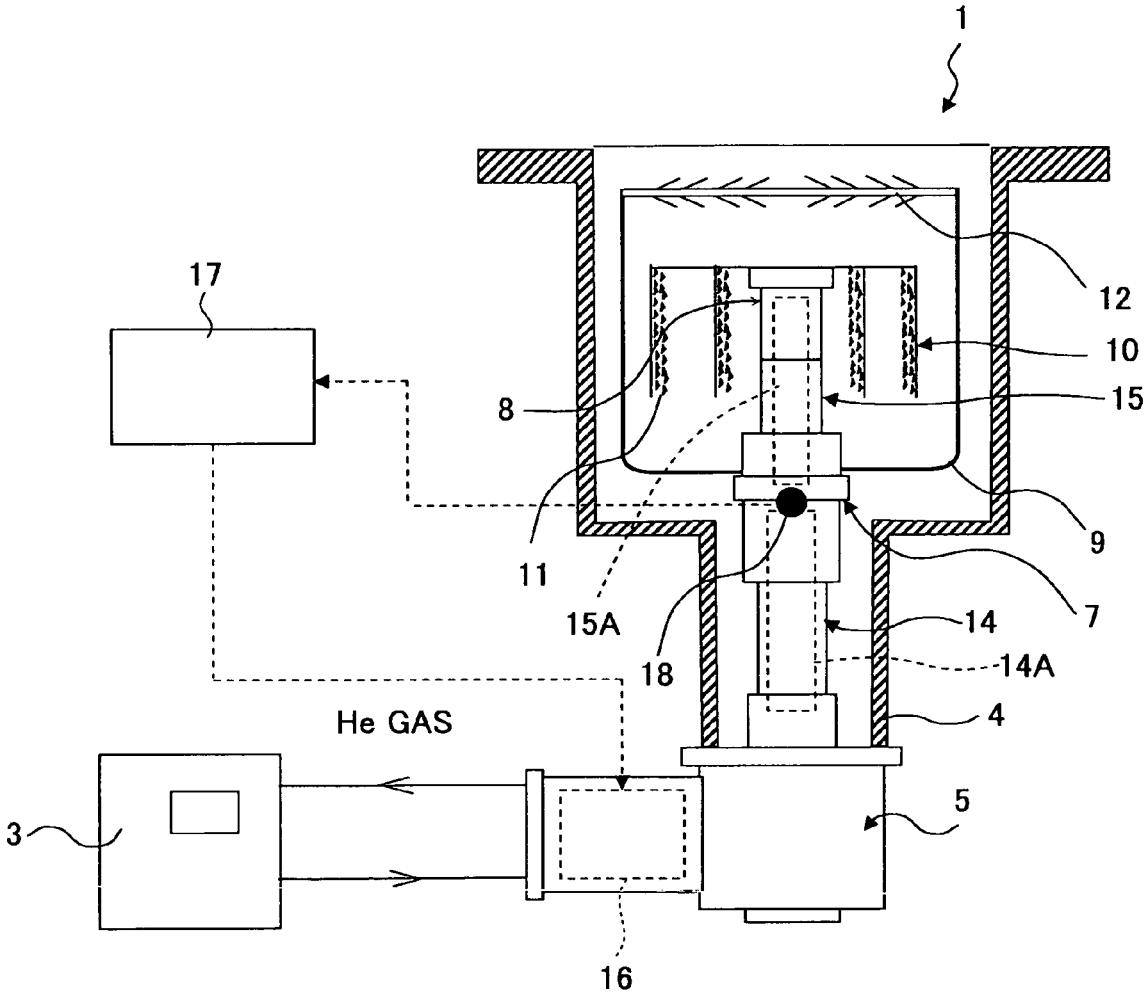
FIG.1 RELATED ART
FIG. 1 is a structural view of a related art cryopump.
Figure 2:
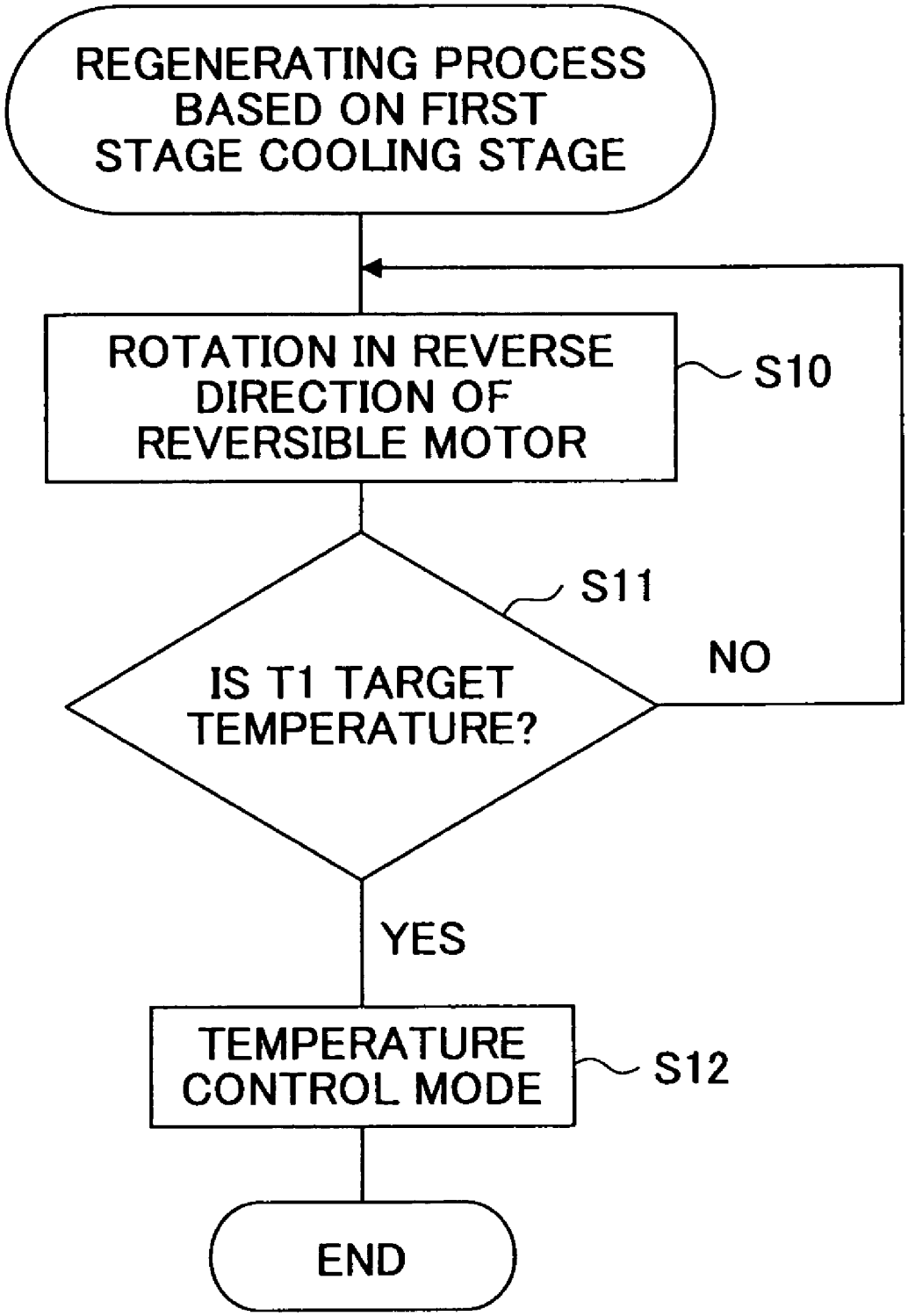
FIG.2 RELATED ART
FIG. 2 is a flowchart indicating a regenerating process of the related art.
Figure 3:
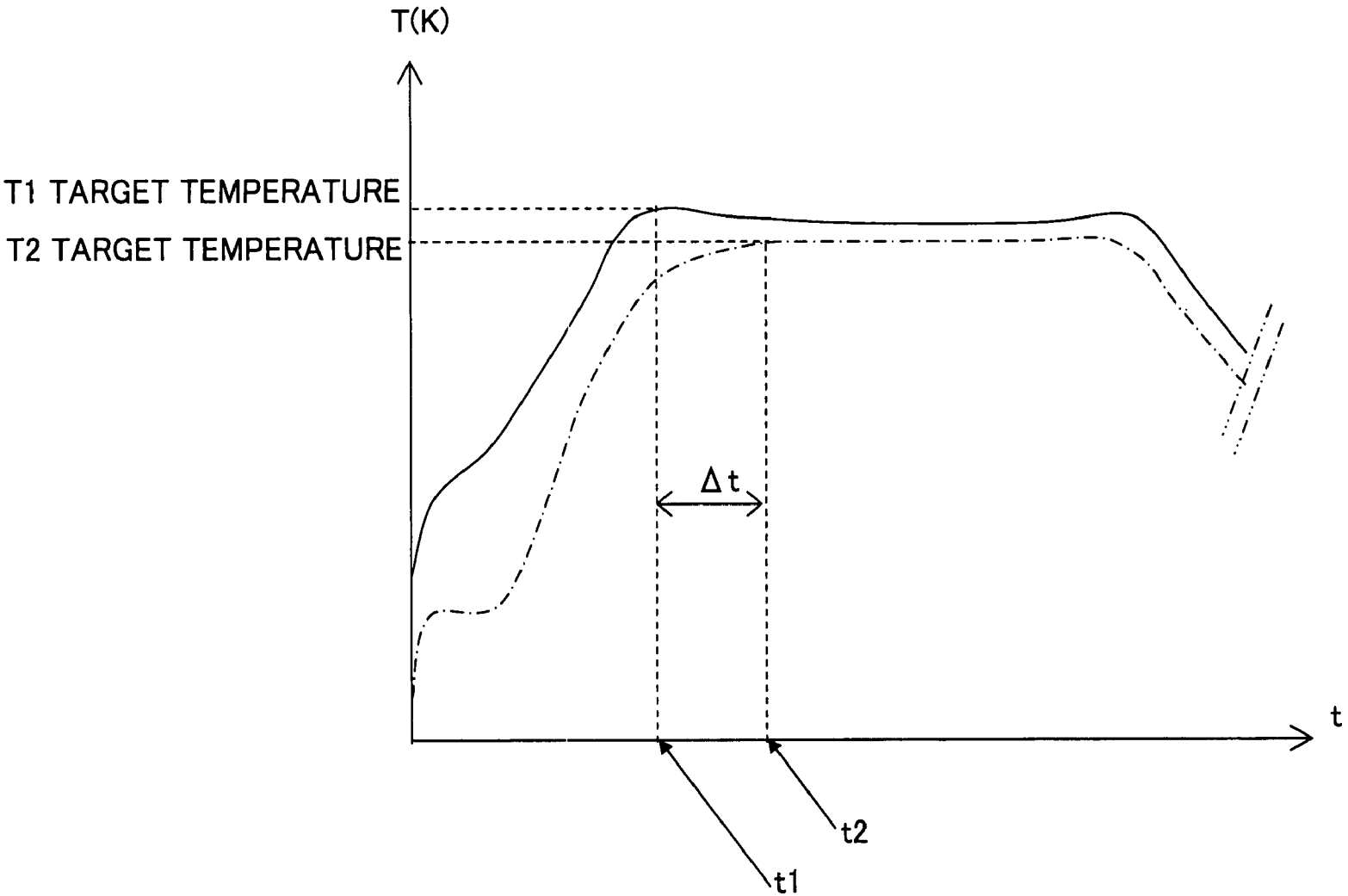
FIG.3 RELATED ART
FIG. 3 is a graph showing temperature changes of the first stage cooling stage 7 and the second stage cooling stage 8 when a regenerating process is controlled based on the temperature detected by a first stage temperature sensor, in the related art cryopump.

In the cryopump 1 shown in FIG. 1, the first stage temperature sensor 18 is provided at only the first stage cylinder 14.

On the other hand, in the cryopump 20 shown in FIG. 5 of the embodiment of the present invention, the first stage temperature sensor 18 is provided at the first stage cylinder 14 and a second stage temperature sensor 19 is provided at the second stage cylinder 15. Temperature of the second stage cylinder 15 is detected by the second stage temperature sensor 19. The first stage temperature sensor 18 and the second stage temperature sensor 19 are connected to the controller 27.

The first stage temperature sensor 18 may be directly provided at the shield 9 and the second stage temperature sensor 19 may be provided at the cryopanel 10. However, in this example, in order to condense and absorb a larger amount of gas in the process chamber so that the vacuum degree is heightened, the first and second stage temperature sensors 18 and 19 are provided at the first and second stage cooling stages 7 and 8 and the temperature of the shield 9 and the cryopanel 10 are determined via the temperatures of the cooling stages 7 and 8, respectively.

Figure 6:
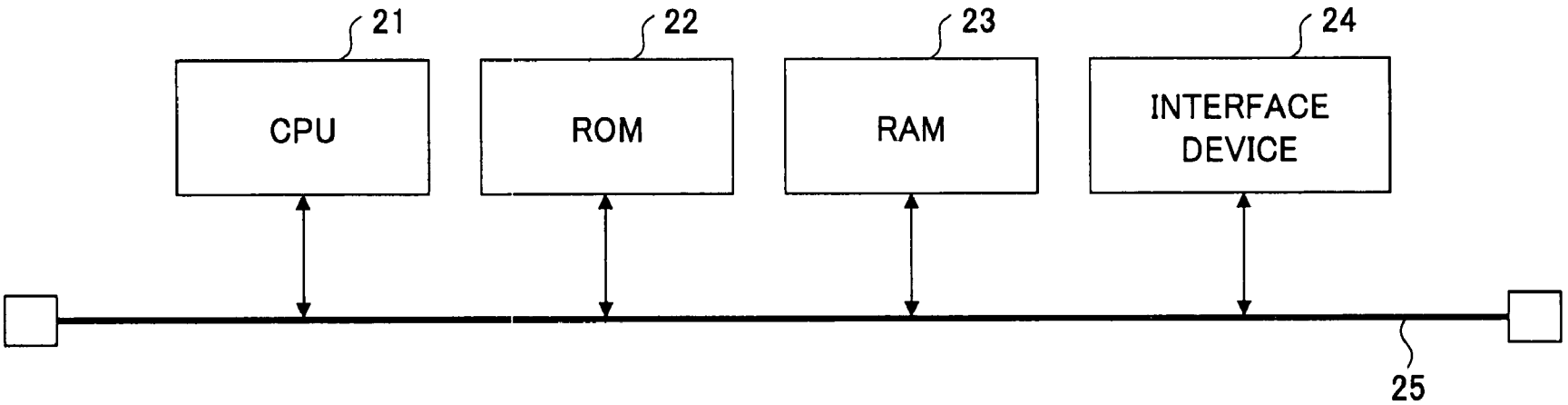
FIG. 6 is a block diagram showing a hardware structure of a controller of the embodiment of the present invention.

FIG. 6 is a block diagram showing a hardware structure of the controller 27 of the embodiment of the present invention.

The controller 27 is formed by a micro computer. As shown in FIG. 6, a central processing unit (CPU) 21, a read only memory (ROM) 22, a random access memory (RAM) 21, and an interface device 24 are connected to each other via a bus line 25.

Figure 7:
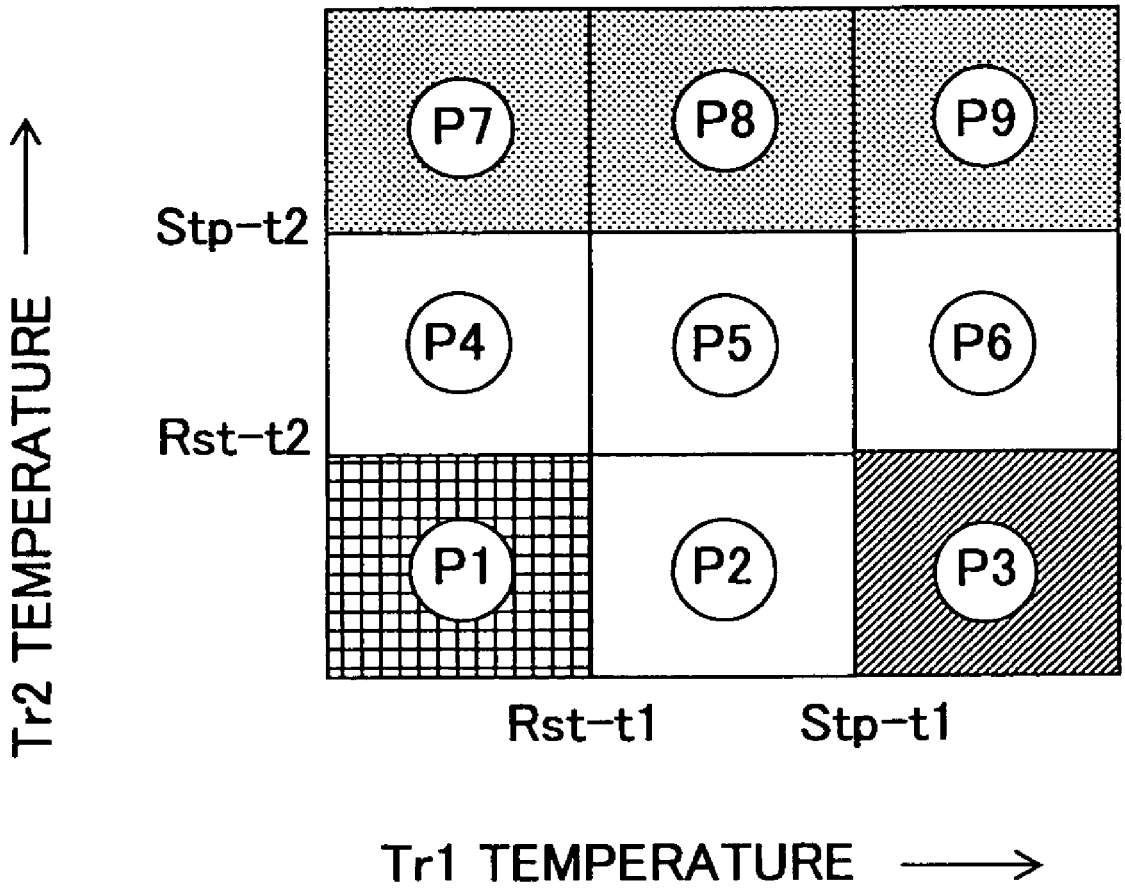
FIG. 7 is a view showing a status table stored in the controller of the embodiment of the present invention.

The first stage temperature sensor 18 and the second stage temperature sensor 19 are connected to the CPU 21 via the interface device 21. In addition, tables discussed below with reference to FIG. 7 and FIG. 8 are stored in the ROM 22 or the RAM 23 in advance.

Next, an example of a regenerating method of the cryopump 20 of the embodiment of the present invention is discussed with reference to FIG. 7 and FIG. 8. In the example of a regenerating method, based on a status table shown in FIG. 7, following a process table shown in FIG. 8, a regenerating process is implemented.

Figure 4:
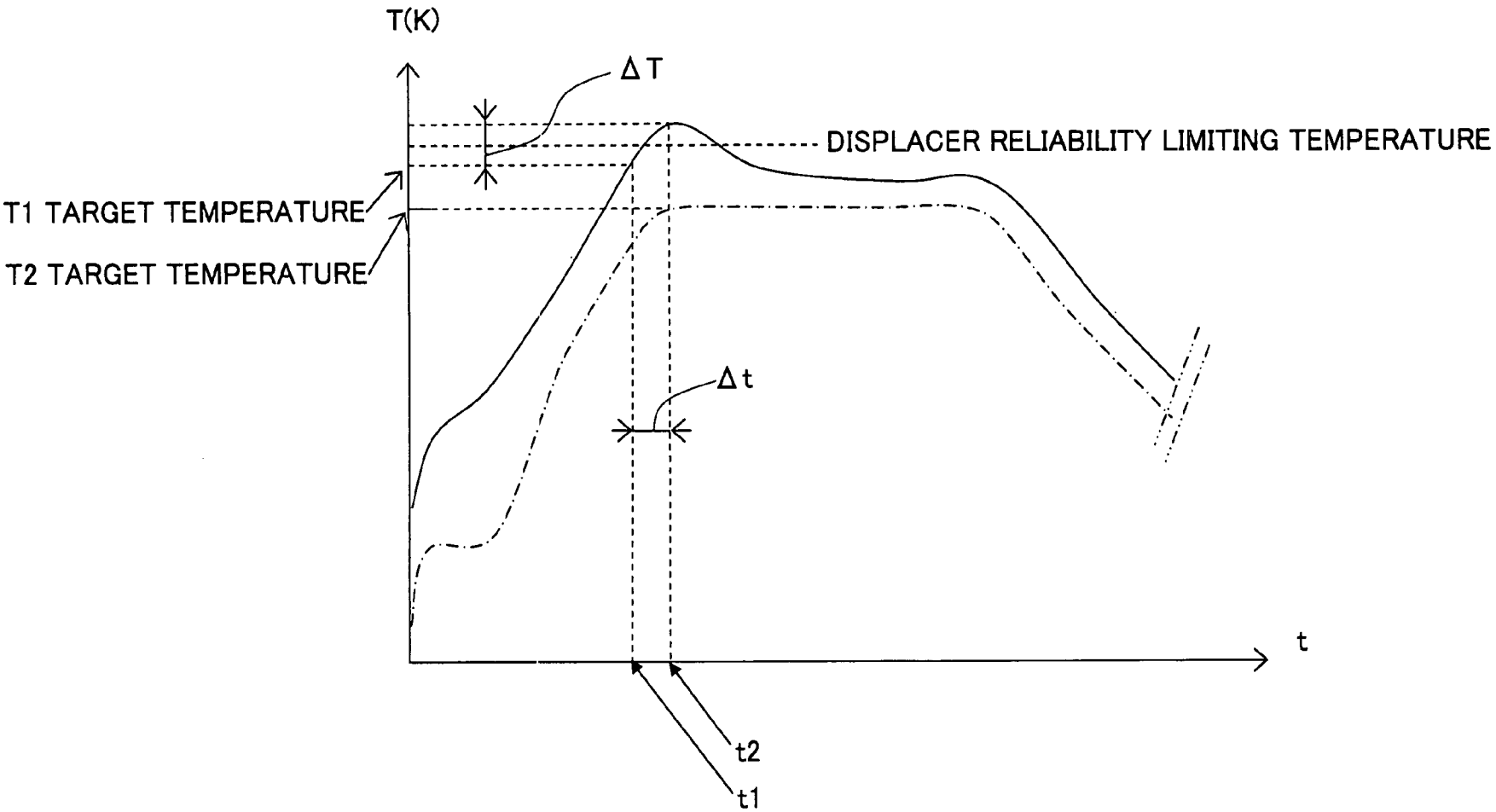
FIG.4 RELATED ART
FIG. 4 is a graph showing temperature changes of the first stage cooling stage 7 and the second stage cooling stage 8 when a regenerating process is controlled based on the temperature detected by a second stage temperature sensor, in the related art cryopump.

In the embodiment of the present invention, a basic regenerating process is implemented based on the temperature of the second stage cooling stage 8 detected by the second stage temperature sensor 19. Under this structure, as discussed with reference to FIG. 4, it is possible to make the time t1 when the temperature of the first stage cooling stage 7 reaches the target temperature T1 and the time t2 when the temperature of the second stage cooling stage 8 reaches the target temperature T2 close each other, and thereby time required for regenerating can be shortened.

However, in a case where control is performed based on the temperature of the second stage cooling stage 8, since the temperature rising rate of the first stage cooling stage 7 is greater than the temperature rising rate of the second stage cooling stage 8, the temperature of the first stage cooling stage 7 may reach the reliability limiting (critical) temperature before the temperature of the second stage cooling stage 8 reaches the target temperature T2.

Because of this, in the embodiment of the present invention, the first stage temperature sensor 18 is provided at the first stage cooling stage 7 so that the temperature of the first stage cooling stage 7 is monitored by the first stage temperature sensor 18. If the temperature of the first stage cooling stage 7 exceeds the reliability limiting (critical) temperature, the reversible motor 16 is stopped so that regenerating is stopped for a while.

For implementing this control, in the embodiment of the present invention, a control returning temperature Rst-t1 and a reliability limiting (critical) temperature Stp-t1 are defined as temperatures of the first stage cooling stage 7. Similarly, a control returning temperature Rst-t2 and a reliability limiting (critical) temperature Stp-t2 are defined as temperatures of the second stage cooling stage 8.

Here, the reliability limiting (critical) temperature Stp-t1 is a limiting temperature for securing reliability. In other words, if the temperature of the first stage cooling stage 7 exceeds the reliability limiting (critical) temperature Stp-t1, a problem such as a seizure may occur in the first stage displacer 14A. Similarly, the reliability limiting (critical) temperature Stp-t2 is a limiting temperature for securing reliability. In other words, if the temperature of the second stage cooling Stage 8 exceeds the reliability limiting (critical) temperature Stp-t2, a problem such as a seizure may occur in the second stage displacer 15A.

In addition, the control returning temperatures Rst-t1 and Rst-t2 are temperatures at which the rotation in the reverse direction of the reversible motor 16 can be restarted.

Thus, if the temperature(s) of the first stage cooling stage 7 and/or the second stage cooling stage 8 exceeds the reliability limiting (critical) temperatures Stp-t1 and/or Stp-t2, the reversible motor 16 is stopped so that the temperature(s) of the first stage cooling stage 7 and/or the second stage cooling stage 8 are/is decreased.

If the temperature(s) of the first stage cooling stage 7 and/or the second stage cooling stage 8 become(s) sufficiently low compared to the reliability limiting (critical) temperatures Stp-t1 and/or Stp-t2, it is necessary to restart the reversible motor 16, namely rotate the reversible motor 16 in the reverse direction, so that the regenerating process is started. The control returning temperatures Rst-t1 and Rst-t2 are temperatures at which the reversible motor 16 can be restarted, namely rotated in the reverse direction.

FIG. 7 is a view showing a status table stored in the controller of the embodiment of the present invention. This status table has a binary map structure where the horizontal axis represents the temperature of the first stage cooling stage 7 and the vertical axis represents the temperature of the second stage cooling stage 8.

The control returning temperature Rst-t1 and the reliability limiting (critical) temperature Stp-t1 are provided at the horizontal axis and the control returning temperature Rst-t2 and the reliability limiting (critical) temperature Stp-t2 are provided at the vertical axis, so that the status table shown in FIG. 7 contains nine statuses indicated by P1 through P9.

For example, in a status indicated by P9 in FIG. 7, the temperature of the first stage cooling stage 7 is higher than the reliability limiting (critical) temperature Stp-t1 and the temperature of the second stage cooling stage 8 is higher than the reliability limiting (critical) temperature Stp-t2.

FIG. 8 is a view showing a regenerating process table based on the status table shown in FIG. 7. More specifically, the process table shown in FIG. 8 indicates processes implemented by the controller 27 to control the reversible motor 16 for the statuses indicated by P1 through P9 of the status table shown in FIG. 7.

In the process table shown in FIG. 8, each of the statuses indicated by P1 through P9 is distinguished by three statuses corresponding to three statuses of the reversible motor 16. Three statues of the reversible motor 16 are as follows. That is, (1) a status where the temperature of the first stage cooling stage 7 exceeds the reliability limiting (critical) temperature Stp-t1 and therefore the reversible motor 16 is stopped;
(2) a status where the temperature of the second stage cooling stage 8 exceeds the reliability limiting (critical) temperature Stp-t2 and therefore the reversible motor 16 is stopped;
(3) a status where the reversible motor 16 being rotated in the reverse direction.

The controller 17 controls the regenerating process based on temperature information from the temperature sensors 18 and 19, the status table shown in FIG. 7 and the process table shown in FIG. 8.

Figure 9:
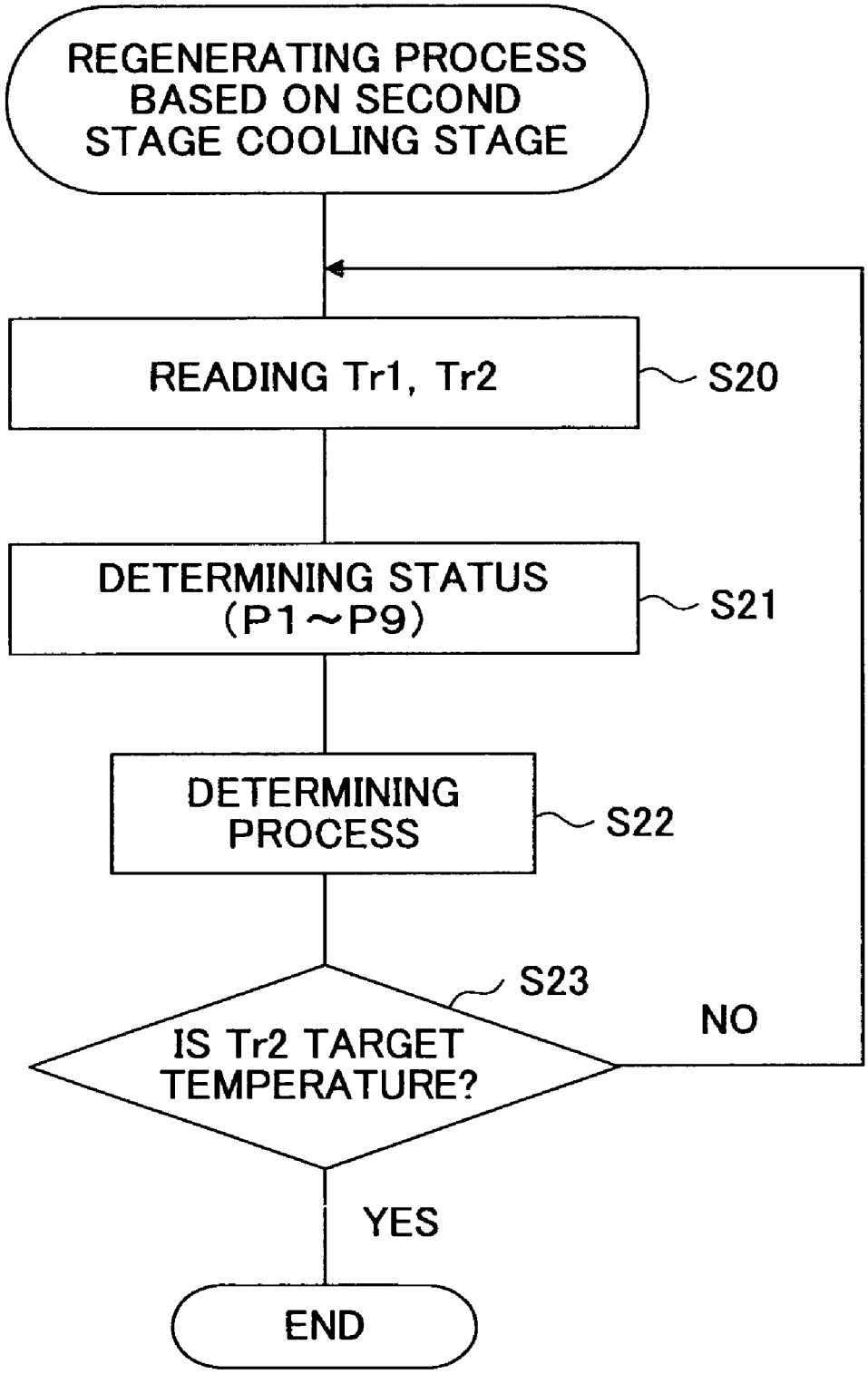
FIG. 9 is a flowchart indicating a regenerating process of the embodiment of the present invention.

FIG. 9 is a flowchart indicating a regenerating process implemented by the controller 27 of the embodiment of the present invention. In the following explanation with reference to FIG. 9, the temperature of the first stage cooling stage 7 detected by the first stage temperature sensor 18 is defined as "Tr1" and the temperature of the second stage cooling stage 8 detected by the second stage temperature sensor 19 is defined as "Tr2".

When the regenerating process shown in FIG. 9 is started, in step S20, the controller 27 receives the temperature Tr1 of the first stage cooling stage 7 from the first stage temperature sensor 18 and the temperature Tr2 of the second stage cooling stage 8 from the second stage temperature sensor 19.

In step S21, the controller 27 determines which one among the statuses indicated by P1 through P9 is a present status of the cryopump 1 based on the status table shown in FIG. 7 and stored in the ROM 22 or the RAM 23.

Next, in step S22, the controller 27 determines a process suitable for the status determined in step S21 and the present status of the reversible motor 16, based on the process table shown in FIG. 8 and stored in the ROM 22 or the RAM 23.

Here, examples of the statuses of the cryopump 1 are discussed.

STATUS EXAMPLE 1

In this status, the temperature Tr2 of the second stage cooling stage 8 is lower than the reliability limiting (critical) temperature Stp-t2, namely, Tr2<Stp-t2; the temperature Tr1 of the first stage cooling stage 7 is higher than the reliability limiting (critical) temperature Stp-t1, namely, Tr1>Stp-t1; and the reversible motor 16 is being rotated in the reverse direction, namely the temperature rising (heating) process is implemented.

In this state, in step S21, the controller 27 determines that the cryopump 1 is in the statuses indicated by P3 and P6 in FIG. 7. In addition, since the reversible motor 16 is being rotated in the reverse direction, the controller 27 extracts processes corresponding to P3 and P6 from the bottom section of the process table shown in FIG. 8.

Thus, the controller 27 determines that the process corresponding to the status example 1 is a process for stopping the rotation of the reversible motor 16.

Therefore, in the case of the status example 1, the temperature Tr2 of the second stage cooling stage 8 does not present a problem. However, if the temperature Tr1 of the first stage cooling stage 7 exceeds the reliability limiting (critical) temperature Stp-t1, the rotation of the reversible motor 16 is stopped so that the temperature Tr1 of the first stage cooling stage 7 is prevented from being increased more.

STATUS EXAMPLE 2

In this status, the temperature Tr2 of the second stage cooling stage 8 is lower than the reliability limiting (critical) temperature Stp-t2, namely, Tr2<Stp-t2; the temperature Tr1 of the first stage cooling stage 7 is lower than the control returning temperature Rst-t1, namely, Tr1<Rst-t1; and the rotation of the reversible motor 16 is stopped because the temperature Tr1 of the first stage cooling stage 7 exceeds the reliability limiting (critical) temperature Stp-t1.

In this state, in step S21, the controller 27 determines that the cryopump 1 is in the statuses indicated by P1 and P4 in FIG. 7. In addition, since the rotation of the reversible motor 16 is stopped because the temperature Tr1 of the first stage cooling stage 7 exceeds the reliability limiting (critical) temperature Stp-t1, the controller 27 extracts processes corresponding to P1 and P4 from the uppermost section of the process table shown in FIG. 8.

Thus, the controller 27 determines that the process corresponding to the status example 2 is a process for restarting the rotation in the reverse direction of the reversible motor 16 so that the regenerating process, namely the temperature rising (heating) control, is restarted.

Therefore, in the case of the status example 2, even if the temperature Tr1 of the first stage cooling stage 7 exceeds the reliability limiting (critical) temperature Stp-t1 so that the rotation of the reversible motor 16 is stopped, the temperature Tr1 is decreased to the control returning temperature Rst-t1 and thereby the reversible motor 16 is immediately restarted and the temperature rising process is started.

Accordingly, while a problem such as a seizure of the first stage displacer 14A is prevented, the regenerating process can be implemented in a short time.

STATUS EXAMPLE 3

In this status, the temperature Tr1 of the first stage cooling stage 7 is lower than the reliability limiting (critical) temperature Stp-t1, namely, Tr1<Stp-t1; the temperature Tr2 of the second stage cooling stage 8 is higher than the reliability limiting (critical) temperature Stp-t2, namely, Tr2>Stp-t2; and the reversible motor 16 is being rotated in the reverse direction, namely the temperature rising process is implemented.

In this state, in step S21, the controller 27 determines that the cryopump 1 is in the statuses indicated by P7 and P8 in FIG. 7. In addition, since the reversible motor 16 is being rotated in the reverse direction, the controller 27 extracts processes corresponding to P7 and P8 from the bottom section of the process table shown in FIG. 8.

Thus, the controller 27 determines that the process corresponding to the status example 3 is a process for stopping the rotation of the reversible motor 16.

Therefore, in the case of the status example 3, the temperature Tr1 of the first stage cooling stage 7 present no problem. However, if the temperature Tr2 of the second stage cooling stage 8 exceeds the reliability limiting (critical) temperature Stp-t2, the rotation of the reversible motor 16 is stopped so that the temperature Tr2 of the second stage cooling stage 8 is prevented from being increased more.

STATUS EXAMPLE 4

In this status, the temperature Tr1 of the first stage cooling stage 7 is lower than the reliability limiting (critical) temperature Stp-t1, namely, Tr1<Stp-t1; the temperature Tr2 of the second stage cooling stage 8 is lower than the control returning temperature Rst-t2, namely, Tr2<Rst-t2; and the rotation of the reversible motor 16 is stopped because the temperature Tr2 of the second stage cooling stage 8 exceeds the reliability limiting (critical) temperature Stp-t2.

In this state, in step S21, the controller 27 determines that the cryopump 1 is in the statuses indicated by P1 and P2 in FIG. 7. In addition, since the rotation of the reversible motor 16 is stopped because the temperature Tr2 of the second stage cooling stage 8 exceeds the reliability limiting (critical) temperature Stp-t2, the controller 27 extracts processes corresponding to P1 and P2 from the middle section of the process table shown in FIG. 8.

Thus, the controller 27 determines that the process corresponding to the status example 4 is a process for restarting the rotation in the reverse direction of the reversible motor 16 so that the regenerating process, namely the temperature rising control, is restarted.

Therefore, in the case of the status example 4, even if the temperature Tr2 of the second stage cooling stage 8 exceeds the reliability limiting (critical) temperature Stp-t2 so that the rotation of the reversible motor 16 is stopped, the temperature Tr2 is decreased to the control returning temperature Rst-t2 and thereby the reversible motor 16 is immediately restarted and the temperature rising process is started.

Accordingly, while a problem such as a seizure of the second stage displacer 15A is prevented, the regenerating process can be implemented in a short time.

In the regenerating process control indicated by the status table shown in FIG. 7 and the process table shown in FIG. 8, the heating part is not limited to the reverse rotation of the cryogenic cooler. The heating part may be a heater or the like. This case as well as the case of the reverse rotation of the cryogenic cooler is effective in that reliability of the cryopump can be kept.

Referring back to FIG. 9, after the regenerating process suitable for the present status of the cryopump 20 is implemented by the processes of step S21 and step S22, in step S23, whether the temperature Tr2 of the second stage cooling stage 8 detected by the second stage temperature sensor 19 reaches the target temperature T2 is determined.

If a negative determination (NO) is made in step S23, the process goes back to the step S20 and the processes in step S20 through S22 are repeated.

On the other hand, if it is determined in step S23 that the temperature Tr2 of the second stage cooling stage 8 detected by the second stage temperature sensor 19 reaches the target temperature T2, the reversible motor 16 is stopped and supply of purge gas is stopped for following vacuum process.

Figure 10:
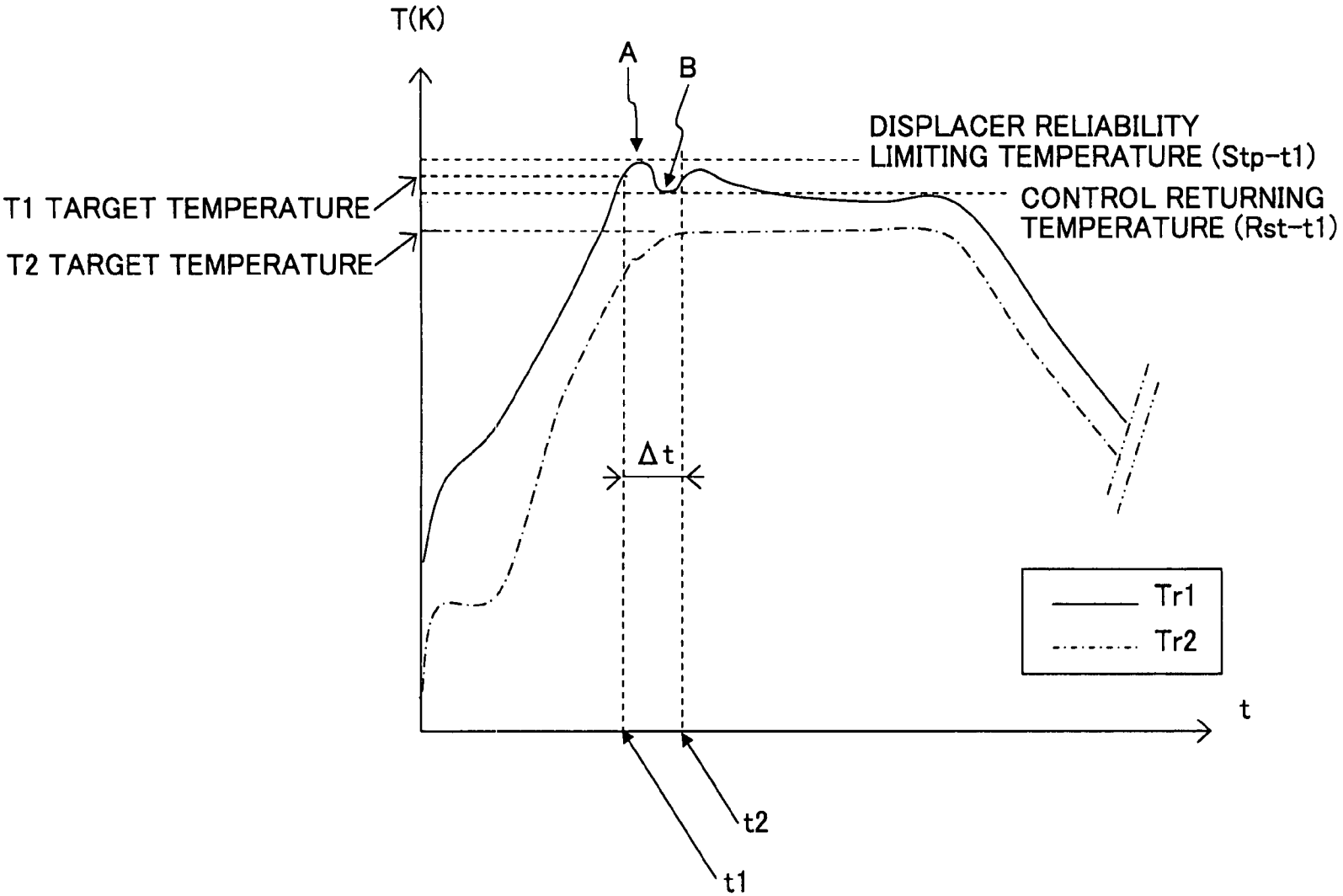
FIG. 10 is a graph showing temperature changes of the cryopump of the embodiment of the present invention.

FIG. 10 is a graph showing temperature changes of the first stage cooling stage 7 and the second stage cooling stage 8 at the time of temperature rising of the embodiment of the present invention.

The horizontal axis of the graph indicates time and the vertical axis of the graph indicates temperature. In addition, a temperature characteristic indicated by a solid line shows change of the temperature Tr1 of the first stage cooling stage 7. A temperature characteristic indicated by a one point dotted line shows change of the temperature Tr2 of the second stage cooling stage 8.

Thus, in the embodiment of the present invention, regenerating is implemented by the temperature rising process based on the temperature Tr2 of the second stage cooling stage 8.

Therefore, the temperature of the first stage cooling stage 7 having the temperature rising rate higher than that of the second stage cooling stage 8 reaches the target temperature T1 earlier than the temperature of the of the second stage cooling stage 8. At the time of t1, the second stage cooling stage 8 has not reach the target temperature T2.

Because of this, after the time t1, the rotation in the reverse direction of the reversible motor 16 is not stopped but is maintained. Hence, in the embodiment of the present invention, after the temperature of the first stage cooling stage 7 reaches the target temperature T1, the temperature of the first stage cooling stage 7 is continues rising.

However, if the temperature Tr1 of the first stage cooling stage 7 exceeds the reliability limiting (critical) temperature Stp-t1 as shown by an arrow A in FIG. 10, the rotation of the reversible motor 16 is stopped so that the temperature Tr1 of the first stage cooling stage 7 is prevented from being increased more.

Accordingly, as discussed above, a seizure of the first stage displacer 14A can be prevented.

Even in the stopping status of the reversible motor 16, since the volume of the second cylinder 15 is smaller than that of the first stage cylinder 14, there is little influence of stopping the rotation of the reversible motor 16, namely stopping rising temperature. Hence, the temperature of the second stage cooling stage 8 continues increasing (but the temperature rising rate is decreased).

Thus, according the embodiment of the present invention, it is possible to make the time t1 when the temperature of the first stage cooling stage 7 reaches the target temperature T1 and the time t2 when the temperature of the second stage cooling stage 8 reaches the target temperature T2 close each other, and thereby it is possible to regenerate the cryopump 20 in a short period of time.

In addition, even if the rising temperature is controlled based on mainly the temperature Tr2 of the second stage cooling stage 8, a seizure of the first stage displacer 14A can be prevented securely.

In the above-discussed embodiment of the present invention, if the temperature Tr1 of the first stage cooling stage 7 exceeds the reliability limiting (critical) temperature Stp-t1, the rotation of the reversible motor 16 is controlled so as to be stopped. However, the present invention is not limited to this example. In other words, as long as the temperature Tr1 of the first stage cooling stage 7 can be decreased, it is not necessary to stop the rotation of the reversible motor 16.

Thus, as discussed above, according to the embodiment of the present invention, it is possible to provide a cryopump, including: a cryogenic cooler, the cryogenic cooler including first and second stage cylinders where first and second stage displacers, respectively, are reciprocally moved; a reversible motor configured to drive the first and second stage displacers, which reversible motor can be rotated in forward and reverse directions; and first and second stage cooling stages provided at the first and second cylinders, respectively, the first and second stage cooling stages being cooled by rotation in the forward direction of the reversible motor and being heated by rotation in the reverse direction of the reversible motor; first and second cryopanels thermally connected to the first and second stage cooling stages, respectively; a first temperature detection part configured to detect a temperature of the first stage cooling stage at the time when the reversible motor is rotated in the reverse direction; a second temperature detection part configured to detect a temperature of the second stage cooling stage at the time when the reversible motor is rotated in the reverse direction; a first control part configured to control the temperature of the second stage cooling stage by controlling the rotation in the reverse direction of the reversible motor based on the temperature detected by the second temperature detection part; and a second control part configured to control the rotation in the reverse direction of the reversible motor in a case where the temperature of the first stage cooling stage detected by the first temperature detection part reaches a limiting temperature of the first stage displacer, the second control part being configured to return the rotation in the reverse direction of the reversible motor to the forward rotation in a case where the temperature of the first stage cooling stage is decreased to a returning temperature.

In the cryopump, the rotation in the reverse direction of the reversible motor may be stopped in the case where the temperature of the first stage cooling stage detected by the first temperature detection part reaches the limiting temperature of the first stage displacer. The rotation in the reverse direction of the reversible motor may be stopped in the case where the temperature of the second stage cooling stage detected by the second temperature detection part reaches a target temperature.

According to the embodiment of the present invention, it is also possible to provide a regenerating method of a cryopump, the cryopump including a cryogenic cooler wherein first and second stage displacers are reciprocally moved in first and second stage cylinders by a reversible motor so that first and second stage expansion space parts, respectively, are heated or cooled; a first cryopanel thermally connected to the first stage cylinder via a first stage cooling stage; a second cryopanel thermally connected to the second stage cylinder via a second stage cooling stage; a first temperature detection part configured to detect a temperature of the first cryopanel at the time when the reversible motor is rotated in a reverse direction; a second temperature detection part configured to detect a temperature of the second cryopanel at the time when the reversible motor is rotated in the reverse direction; wherein the temperatures of the first and second cryopanels are increased by adiabatic compression heat generated in the first and second expansion space parts, respectively, by rotation in the reverse direction of the reversible motor so that the regenerating method is implemented, the regenerating method including: a step of controlling the rotation in the reverse direction of the reversible motor based on the temperature detected by the second temperature detection part so that regenerating temperature of the second cryopanel is controlled; a step of controlling the rotation in the reverse direction of the reversible motor in a case where the temperature of the first cryopanel detected by the first temperature detection part reaches a limiting temperature of the first stage displacer; and a step of returning the rotation in the reverse direction of the reversible motor to a forward rotation in a case where the temperature of the first cryopanel is decreased to a returning temperature.

In the regenerating method, the rotation in the reverse direction of the reversible motor may be stopped in the case where the temperature of the first stage cooling stage detected by the first temperature detection part reaches the limiting temperature of the first stage displacer. The rotation in the reverse direction of the reversible motor may be stopped in the case where the temperature of the second stage cooling stage detected by the second temperature detection part reaches a target temperature.

The present invention is not limited to these embodiments, but variations and modifications may be made without departing from the scope of the present invention.

This patent application is based on Japanese Priority Patent Application No. 2006-128499 filed on May 2, 2006, the entire contents of which are hereby incorporated by reference.

What is claimed is:

1. A cryopump control apparatus comprising:

a first temperature detector configured to detect a temperature of a first cooling stage of a cryopump;

a second temperature detector configured to detect a temperature of a second cooling stage of the cryopump;

a reversible motor being configured to drive a first stage displacer of the first cooling stage and a second stage displacer of the second cooling stage;

a controller configured to receive a detection of the temperature of the second cooling stage and control the temperature of the second cooling stage by controlling the speed and direction of rotation of the reversible motor, the controller also configured to receive a detection of the temperature of the first cooling stage, and, in the case that the temperature of the first cooling stage rises above a first critical temperature, reduce the temperature of the first cooling stage by controlling the speed and direction of the reversible motor, in the case that the temperature of the first cooling stage falls below a first returning temperature, increase the temperature of the first cooling stage by controlling the speed and direction of rotation of the reversible motor, and, in the case that the temperature of the second cooling stage reaches a second stage target temperature, stops the rotation of the reversible motor, wherein the controller is operative during regenerating both of a first panel connected to the first cooling stage and a second panel connected to the second cooling stage by rotation of the reversible motor in a reverse direction.

2. The cryopump control apparatus according to claim 1, wherein the first critical temperature is a reliability temperature, which, if the temperature of the first cooling stage is maintained below the first critical temperature, seizure of the first stage displacer is prevented.

3. The cryopump control apparatus according to claim 1, wherein the first returning temperature is the temperature at which rotation of the reversible motor is restarted in the reverse direction.

4. The cryopump control apparatus according to claim 1, wherein in the case that the temperature of the first cooling stage rises above the first critical temperature, the controller reduces the temperature of the first cooling stage by stopping the rotation of the reversible motor.

5. The cryopump control apparatus according to claim 1, wherein during regeneration the temperatures of the first and second cooling stages rise interdependently.

6. The cryopump control apparatus according to claim 1, wherein a temperature rising rate of the first cooling stage is different than a temperature rising rate of the second cooling stage.

7. The cryopump control apparatus according to claim 1, wherein a volume of an expansion room of the first cooling stage is larger than a volume of an expansion room of the second cooling stage.

8. A regenerating method for a cryopump, the method comprising:

detecting a temperature of a first cooling stage of the cryopump;

detecting a temperature of a second cooling stage of the cryopump;

receiving a detection of the temperature of the second cooling stage and, based on the received temperature of the second cooling stage, controlling the temperature of the second cooling stage by controlling the speed and direction of rotation of a reversible motor configured to drive a first stage displacer of the first cooling stage and a second stage displacer of the second cooling stage;

receiving a detection of the temperature of the first cooling stage, and, in the case that the temperature of the first cooling stage rises above a first critical temperature, reducing the temperature of the first cooling stage by controlling the speed and direction of the reversible motor, in the case that the temperature of the first cooling stage falls below a first returning temperature, increasing the temperature of the first cooling stage by controlling the speed and direction of rotation of the reversible motor, and in the case that the temperature of the second cooling stage reaches a target temperature, stopping the rotation of the reversible motor; and regenerating both of a first panel connected to the first cooling stage and a second panel connected to the second cooling stage by rotation of the reversible motor in a reverse direction.

9. The regenerating method for a cryopump according to claim 8, wherein the first critical temperature is a reliability temperature, which, if the temperature of the first cooling stage is maintained below the first critical temperature, seizure of the first stage displacer is prevented.

10. The regenerating method for a cryopump according to claim 8, wherein the first returning temperature is the temperature at which rotation of the reversible motor is restarted in the reverse direction.

11. The regenerating method for a cryopump according to claim 8, further comprising stopping the rotation of the reversible motor if the temperature of the first cooling stage rises above the first critical temperature.

12. The regenerating method for a cryopump according to claim 8, wherein during regeneration the temperatures of the first and second cooling stages rise interdependently and a temperature rising rate of the first cooling stage is different than a temperature rising rate of the second cooling stage.

13. The regenerating method for a cryopump according to claim 8, wherein a temperature rising rate of the first cooling stage is different than a temperature rising rate of the second cooling stage.

14. The regenerating method for a cryopump according to claim 8, wherein a volume of an expansion room of the first cooling stage is larger than a volume of an expansion room of the second cooling stage.

* * * * *